US005242197A

United States Patent [19]

Raynak

[11] Patent Number: 5,242,197

[45] Date of Patent: Sep. 7, 1993

[54] FILING FOLDER FOR DIAGNOSTIC IMAGING FILMS

[76] Inventor: Frank R. Raynak, 2518 N. Jefferson Extension, New Castle, Pa. 16105

[21] Appl. No.: 737,359

[22] Filed: Jul. 29, 1991

[51] Int. Cl.[5] ..... B42F 21/00; B42F 21/12

[52] U.S. Cl. ..... 283/37; 283/114; 281/51

[58] Field of Search ..... 283/37, 114; 287/15.1, 287/51; 402/80 R

[56] References Cited

U.S. PATENT DOCUMENTS

| | | | |
|---|---|---|---|
| 1,634,064 | 6/1927 | Ahlquist | 281/15.1 X |
| 2,871,901 | 2/1959 | Nash | 150/39 |
| 2,918,921 | 12/1959 | Carlston | 129/16.1 |
| 3,435,868 | 4/1969 | Stermer | 150/39 |
| 3,464,135 | 9/1969 | Eidinger | 40/159 |
| 4,260,055 | 4/1981 | Slaybaugh | 206/232 |
| 4,913,462 | 4/1990 | Parker | 281/15.1 |

*Primary Examiner*—Paul A. Bell
*Attorney, Agent, or Firm*—Harpman & Harpman

[57] ABSTRACT

A filing folder having front and back panels and panels forming a plurality of open top pockets of a size to receive one or more X-ray, CT scan, or MRI films. Longitudinally spaced cut-outs formed in the upper edge of the front panel and each of the pocket forming panels has a cutaway area along its upper edge and color coding on the remaining upper edge portion of each of the panels so as to be seen through the longitudinally spaced cut-outs whereby films in the pockets may be identified as relating to the subject matter of the color coded pockets of the device.

5 Claims, 2 Drawing Sheets

FILING FOLDER FOR DIAGNOSTIC IMAGING FILMS

BACKGROUND OF THE INVENTION

1. Technical Field

This invention relates to file folders for storing and protecting diagnostic imaging films or other special record keeping sheets and particularly concerns such folders and their method of use in keeping records such as diagnostic imaging films over an extended period of time wherein the multiple films are required preferably in type and purpose.

2. Description of the Prior Art

Various types of wallets, billfolds, card carrying cases, and pocket receptacles are well known and many of them include multiple pockets for storing various items such as identification cards, vehicle operators licenses, credit cards, photographs, and the like.

The following U.S. Patents are those known to applicant relevant to this invention:

| | | |
|---|---|---|
| 1,634,064 | June 28, 1927 | Ahlquist |
| 2,871,901 | Feb. 3, 1959 | Nash |
| 2,918,921 | Dec. 29, 1959 | Carlston |
| 3,435,868 | April 1, 1969 | Stermer |
| 3,464,135 | Sept. 2, 1969 | Eidinger |
| 4,260,055 | April 7, 1981 | Slabaugh |
| 4,913,462 | April 3, 1990 | Parker |

None of the above-mentioned patents discloses a filing folder for diagnostic imaging films specifically adapted for storing and identifying films stored therein by type or purpose grouping with visual indication of films in such groups or purpose as well as arranged for convenient sorting of such films to enable medical personnel to readily determine the availability of such films of a patient as exist and are available for examination.

SUMMARY OF THE INVENTION

A filing folder for diagnostic imaging films comprises a pair of spaced front and back panels and a plurality of vertical panels movably positioned therebetween. Folding creased accordian-like end and bottom members are attached to the ends and bottoms of the front and back panels and the bottom edges of each of the movable interior panels so that the device may be compressed or expanded as needed. The front panel has a plurality of longitudinally spaced cut-outs in its upper edge and each of the movable panels positioned inwardly of the front panel have portions of their upper edges cutaway so as to leave portions of their upper edges visible through one of the longitudinally spaced cut-outs in the upper edge of the front portion. Color or other indicia coding is applied to the visible portions of the movable panels and the back panel and keyed to indicia on the front panel identifying the areas of a body to which the diagnostic imaging films relate. For example the chest, the bones, the GI tract or miscellaneous other portions.

Films positioned in each of the pockets defined by the movable panels between the front and back panels may therefore be grouped as to the classification they display and are conveniently visually grouped by the different lengths and color codes of the remaining portion of each of the movable panels.

DESCRIPTION OF THE PREFERRED EMBODIMENT

In its simplest form the filing folder for diagnostic imaging films is preferably formed of relatively stiff paper of an overall size greater than the overall size of conventional X-ray and CT scan and MRI films, for example an overall width of 18¼, a height of 14½" and a variable thickness depending on the position of the folding creased accordian-like end and bottom members of 1". The folder itself is formed of a front panel 10 and a back panel 11 spaced by folding creased accordian-like end members 12 and 13 respectively and a folding creased accordian-like bottom member 14. There are several panels (three are shown) positioned between the front panel 10 and the back panel 11.

Figure 1:
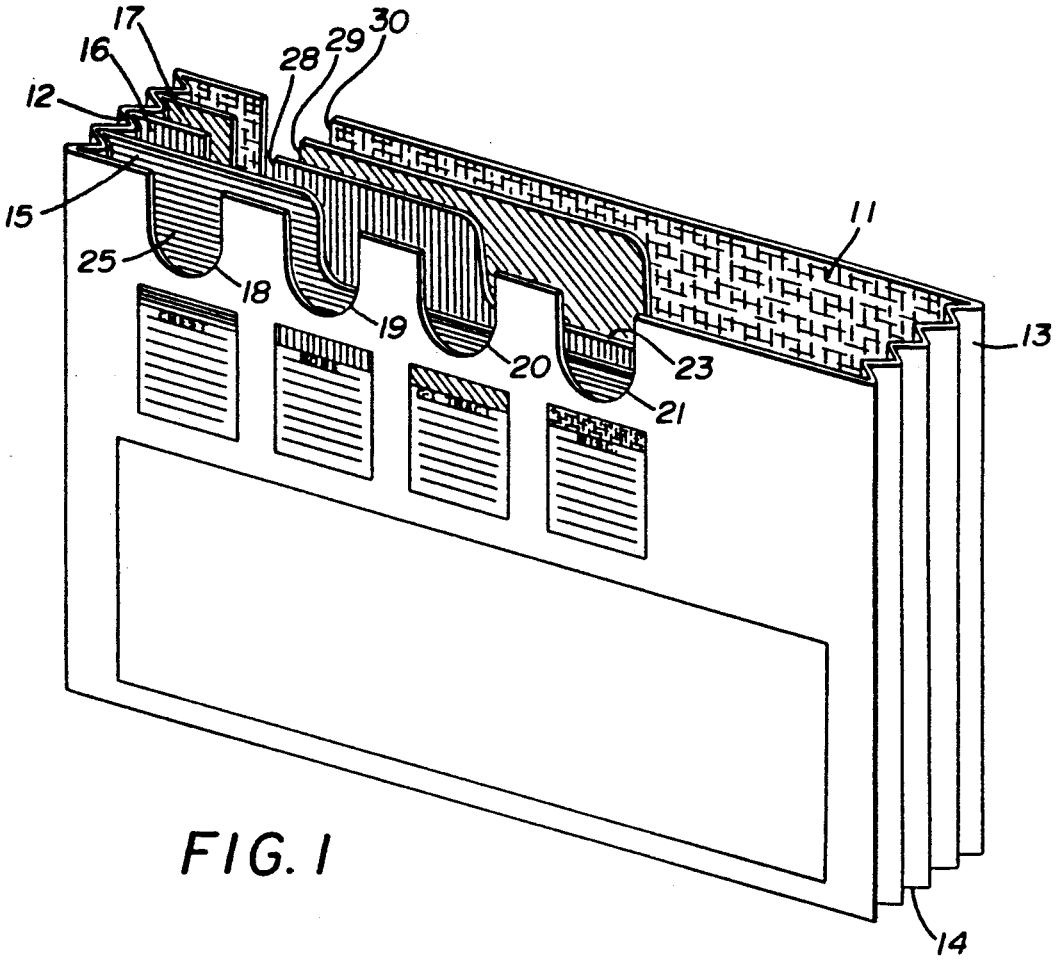
FIG. 1 is a perspective elevation of the filing folder for diagnostic imaging films.

In the form of the invention disclosed herein, there is a first panel 15, a second panel 16 and a third panel 17, see FIG. 1, spaced in relation to one another and spaced with respect to the front panel 10 and the back panel 11 so that the spaces therebetween comprise pockets for the reception of one or more X-ray, CT scan and/or MRI diagnostic imaging films.

Figure 2:
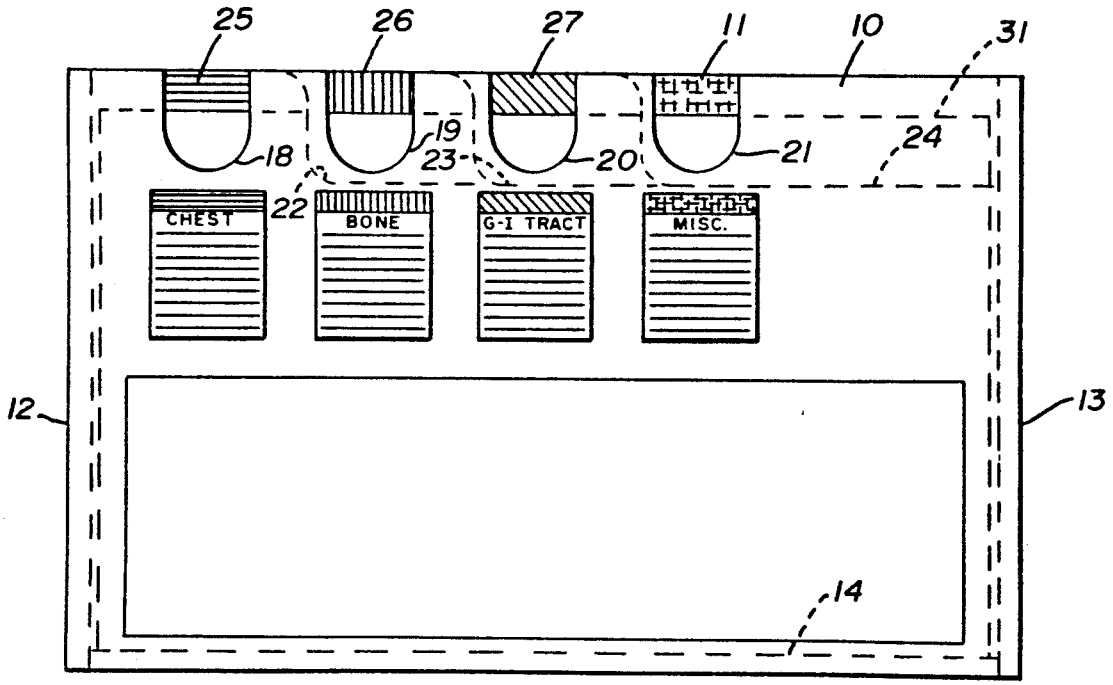
FIG. 2 is a front plan view of the filing folder shown in FIG. 1 with broken lines indicating the end and bottom members and the cutaway portions of the front, back and movable panels.

By referring to FIGS. 1 and 2 of the drawings, it will be seen that the front panel 10 has been formed with a plurality of cut-outs 18, 19, 20 and 21 respectively, spaced longitudinally in the upper edge of the front panel 10 so as to extend downwardly therein a distance sufficient so that the upper edge portion of a diagnostic imaging film positioned in a pocket defined by the device may be visually observed.

Still referring to FIGS. 1 and 2 of the drawings, it will be seen that upper portions of each of the movable panels 15, 16 and 17 have been cutaway for part of their longitudinal length so that the first panel 15 had the longest cutaway area 22, the second panel 16 had the next longest cutaway area 23 and the third panel 17 has the shortest longitudinal cutaway area 24. These configurations result in an upstanding tab-like portion 25 on the left end of the first panel 15, a longer upstanding tab 26 on the second panel 16 and a still longer upwardly extending tab 27 on the third panel 17, all as best seen in FIGS. 1 and 2 of the drawings.

It will be seen that the tab 25 is visible through the cut-out 18 in the front panel 10, the tab 16 is visible through the cut-out 19 in the front panel 10 of the device, the tab 17 is visible through the cut-out 20 in the front panel 10 and the back panel 11 is visible through the cut-out 21 in the front panel 10 of the device.

Still referring to FIGS. 1 and 2 of the drawings, it will be seen that these tabs 25, 26, 27 and the interior of the back panel 11 are color coded for the colors blue, red, green, and yellow respectively, and that matching color or word indicia is provided on the front panel 10 immediately beneath each of the cut-outs 18, 19, 20 and 21 which may indicate respectively films relating to the chest, bones, Gi tract and miscellaneous associated with the color coding for example only of blue, red, green and yellow respectively.

Still referring to FIG. 1 of the drawings, it will be observed that cut-outs 28, 29 and 30 respectively are formed in the upper edge of the second panel 16, the third panel 17 and the back panel 11 in registering alignment with the cut-out 18 in the upper edge of the front panel 10.

Figure 3:
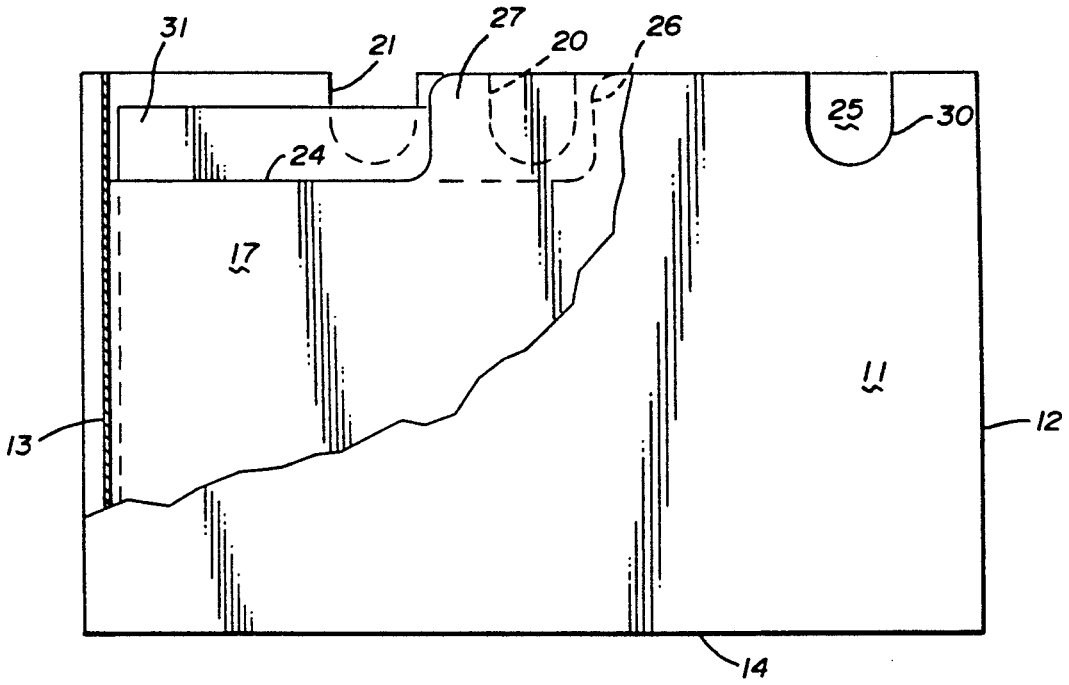
FIG. 3 is a back elevation of the filing folder with parts broken away and parts in cross section.

By referring now to FIG. 3 of the drawings, which is a back plan view, it will be seen that a portion of the back panel 11 has been broken away to disclose the third panel 17 and its relatively shorter cutaway area 24 and the remaining upstanding elongated tab-like upper edge portion 27 of the third panel 17 as heretofore described.

Still referring to FIG. 3 of the drawings, it will be seen that the upper longitudinal edge portion of a diagnostic imaging film 31 is illustrated as positioned in the open top pocket formed in the device by the front panel 10 and the first movable panel 15 and the end and back members 12, 13 and 14.

Referring again to FIGS. 1, 2 and 3 of the drawings, it will be seen that the first, second and third movable panels 15, 16, and 17 are affixed at their ends to the folding creased accordian-like ends 12 and 13 by the formation of sharp angular vertical flanges formed on the ends of each of the first, second and third movable panels 15, 16 and 17 respectively.

In FIG. 1 of the drawings, the sharply inturned vertical flange on the left end of the back panel 10 is shown attached to the right angular flange comprising the rear edge of the folding creased accordian-like end 12. Each of the movable panels 15, 16 and 17 are also provided with sharply inturned vertical flanges on their opposite ends and these in turn are affixed as by glue to the vertical folding creased accordian-like ends 12.

The same manner of affixing the bottom edges of the front panel 10 and back panel 11 to the bottom edges of the first, second and third movable panels 15, 16, and 17 is provided as represented by broken lines showing the inturned flanges joined to one another on the ends and bottom of the folder.

In FIG. 3, the cross section of the folding creased accordian-like end 13 is taken at the apex of the V-shaped inner edges of the folding creased accordian-like end 13.

It will be seen that the filing folder disclosed herein has been designed for protectively filing and classifying diagnostic imaging films such as X-ray, CT scan and MRI films in a convenient lightweight folder in which the films may be easily grouped in desirable classifications and when positioned in the open top pockets formed in the device, they are easily recognized in the particular classifications or groups desired and visually seen in the device of the invention.

The principal novelty in the filing folder comprises its cutaway areas and the preferable indicia and/or color coding applied to portions of the upstanding pockets in the device as established by the cutaway areas hereinbefore described.

For example, it will be seen that when films of the chest of a patient are positioned in the pocket between the front panel 10 and the first movable panel 15, they appear in the cut-out 18 and in front of the identifying color coding on the first panel 15 and they are visible and clearly indicate their presence in the classification shown. Similarly, films positioned in the open top pocket between the second and third movable panels 15 and 16 are not visible in the left hand cut-out 18 in the front panel 10, but are visible in the next cut-out 19 in position in front of the color coded background indicated by red shading or lining in the present disclosure thus indicating one or more of a collection of films of the category indicated by the color coding and/or indicia as hereinbefore explained.

Similarly, the X-ray film or films in a group positioned in the third cut-out 20 are not visible in the first and second cut-outs 18 and 19 and their color coding clearly indicates the proper place in which the films are positioned and the particular classification in which they are grouped.

Films positioned in the last upstanding pocket, that between the third panel 17 and the back panel 11 of the device, are visible through the cut-out 21 and are therefore easily located.

The novelty of the longitudinally extending tabs 25, 26 and 27 hiding progressive groups of films positioned in the upstanding pockets from the front panel 10 to the back panel 11 is particularly helpful in locating the desired group of films as each group is always associates with a color coded area of the device and are readily visible in connection therewith which considerably expedites the location of and removal of a desired group of films desired by the medical personnel examining the diagnostic imaging films.

Although but one embodiment of the present invention has been illustrated and described, it will be apparent to those skilled in the art that various changes and modifications may be made therein without departing from the spirit of the invention and having thus disclosed my invention, what I claim is:

I claim:

1. A filing folder having front and back panels and several panels positioned therebetween defining a plurality of open top pockets of a size to receive X-ray, CT scan and MRI films, longitudinally spaced cut-outs formed in the upper edge of the front panel and longitudinally cutaway portions in the upper edge of each of said movable panels, color coding on the remaining upper edge of each of the movable panels visible through the respective longitudinally spaced cut-outs in the front panel whereby films in said pockets are identified by the color coding on the remaining upper edge portions of the movable panels and on the back panel of the filing folder, indicia on the front panel indicates the subject matter of the films positioned in each of the color coded pockets.

2. The structure as defined in claim 1 wherein folding creased accordian-like end and bottom members are joined to said front and back panels and said several panels therebetween.

3. The structure as defined in claim 1 wherein there are first, second and third panels between said front and back panels and wherein said longitudinally cutaway portion in said first of said panels between said front and back panels is of a known length and said cutaway portion in said second one of said panels between said front and back panels is of a length shorter than said known length of said first panel and wherein said longitudinally cutaway portion of said third panel between said front and back panels is of a length shorter than the length of the cutaway portion of said second panel whereby said remaining upper edge of each of the first, second and third panels between said front and back panels are progressively longer with respect to one another and wherein the color coding on each of said remaining upper edge of each of said panels between said front and back panels are different from one another whereby said remaining upper edge of each of said panels between said front and back panels form tabs on said panels arranged in longitudinally staggered relation substantially throughout the length of said open top pocket.

4. The structure as defined in claim 1 wherein said front and back panels and the several panels positioned therebetween are rectangular and the plurality of open top pockets formed thereby are open on a long edge portion thereof.

5. The structure as defined in claim 1 wherein said each of said several panels positioned between said front and back panels have straight inwardly folded narrow flanges on their opposite ends, and wherein folding creased accordian-like end members are joined to each of said straight inwardly folded narrow flanges on the opposite ends on each of said several panels and wherein a folding creased accordian-like bottom member is joined to said front and back panels with said several panels therebetween engaging said folding creased accordian-like bottom member.

* * * * *